United States Patent [19]

Hall et al.

[11] Patent Number: 4,508,002

[45] Date of Patent: Apr. 2, 1985

[54] METHOD AND APPARATUS FOR IMPROVED AUTOMATIC HARMONIZATION

[75] Inventors: George R. Hall, Sherman Oaks; Robert J. Hall, Chatsworth; Jack C. Cookerly, Saugus, all of Calif.

[73] Assignee: Norlin Industries, White Plaines, N.Y.

[21] Appl. No.: 274,606

[22] Filed: Jun. 17, 1981

Related U.S. Application Data

[63] Continuation-in-part of Ser. No. 3,584, Jan. 15, 1979, abandoned.

[51] Int. Cl.[3] ..... G10F 1/00

[52] U.S. Cl. ..... 84/1.03; 84/1.24; 84/DIG. 22

[58] Field of Search ..... 84/1.03, DIG. 22, 1.24, 84/1.01

[56] References Cited

U.S. PATENT DOCUMENTS

| | | | |
|---|---|---|---|
| 3,247,310 | 4/1966 | Stinson, Jr. | 84/1.17 |
| 3,283,056 | 11/1966 | Cookerly et al. | 84/1.01 |
| 3,694,562 | 9/1972 | Hiyma | 84/1.19 |
| 3,745,225 | 7/1973 | Hall | 84/1.03 |
| 3,929,051 | 12/1975 | Moore | 84/1.17 |
| 3,955,459 | 5/1976 | Mochida et al. | 84/1.01 |
| 3,990,339 | 11/1976 | Robinson et al. | 84/1.17 |
| 4,112,802 | 9/1978 | Robinson et al. | 84/1.01 |
| 4,197,777 | 4/1980 | Wheelwright | 84/1.03 |
| 4,208,939 | 6/1980 | Wangard et al. | 84/1.17 |
| 4,232,581 | 11/1980 | Uchiyama | 84/1.03 |
| 4,295,402 | 10/1981 | Devtsch et al. | 84/1.03 |

*Primary Examiner*—F. W. Isen

*Attorney, Agent, or Firm*—Nilsson, Robbins, Dalgarn, Berliner, Carson & Wurst

[57] ABSTRACT

A method and associated apparatus for embellishing the melody played on an electronic musical keyboard instrument. A set of musically-derived tables relates harmonious accompaniment notes to the melody in accordance with the chosen harmony and is addressed to generate a signal that represents at least one appropriate accompaniment note. The latter signal causes sounding of selected accompaniment notes to produce the desired musical harmony. A choice of voicing style and an orchestration option are additionally provided within the scope of the apparatus and method herein.

18 Claims, 9 Drawing Figures

METHOD AND APPARATUS FOR IMPROVED AUTOMATIC HARMONIZATION

CROSS-REFERENCE TO RELATED APPLICATION

This is a continuation-in-part of pending U.S. patent application Ser. No. 3,584 filed Jan. 15, 1979 for "Orchestral Acompaniment Techniques", now abandoned.

FIELD OF THE INVENTION

The field of art to which this invention pertains is electronic musical instrumentation. In particular, the present invention pertains to instruments that incorporate automatic orchestration control.

BACKGROUND AND SUMMARY OF THE INVENTION

It is well known in the field of automatic harmonization to generate a group of one or more harmony notes to accompany the melody note selected by a performer. Prior art methods have utilized both mechanical and electronic means to occasion the sounding of one or more notes below the melody note. In general, these systems add only the harmony notes selected on the accompaniment keyboard. These notes are sounded in a limited, preselected musical compass below the selected melody note. Examples of such systems are found in U.S. Pat. Nos. 3,283,056 issued Nov. 1, 1966 for "CONTROLLED HARMONIZATION FOR MUSICAL INSTRUMENTS", a mechanical system, and 3,929,051 issued Dec. 30, 1975 for "MULTIPLEX HARMONY GENERATOR", an electronic system.

Systems as above-referenced only approximate musically optimal harmony. Oftentimes, harmony, of which the above is an approximation, is best achieved by adding tones from the scale of the selected harmony chord other than chordal tones.

In popular music, melody notes which are not chord tones of the given harmony may be classified as various kinds of passing tones (i.e., appoggiaturas, suspensions, etc.), according to their position and function relative to the scale from which the given harmony was derived. By harmonizing such tones accordingly, the skilled musician may prevent harmony tones from making awkward skips, provide more logical voice leadings and increase harmonic interest. It is additionally customary for the skilled musician to add additional harmonizing tones such as sixths, sevenths, and ninths not present in the given chord to melody notes while sometimes omitting certain of the tones of the given harmony. These techniques add "fullness" and "color" to the sound.

For example, in FIG. 7 there is shown a line of music from the tune "Melancholy Baby". The topmost set of bars contains the melody of the piece while the bottommost contains its harmony. Using the standard orchestration control systems described above, one would sound the embellished melody of the second line of music (written in treble clef). ("Embellished" as referred to in this application is to be understood to be of the homophonic type wherein homophonic denotes music in which a single melody is supported by chords as distinguished from monophonic and polyphonic.) A preferred musical harmonization (which, it will be seen, is obtained by means of the present invention) is contained in the third set of lines.

Comparing the second and third lines of FIG. 7, starting with the first note ("E"), line three presents a four-part harmonization by adding the tones "C", "A" and "G" to the melody tone "E". The note "A", for example, is not part of the given harmony. The second melody note ("F") presents a more complex situation. Line two shows the addition of "C" and "G" (the same two notes added to melody note "E"). Since melody note "F" is not compatible with the harmony tone "E" of the given harmony, the "E" note is omitted, leaving a poorly defined chord (a "C" major chord containing the suspended note "F"). The melody note "F" comprises a passing tone. Proper harmonization is shown in line three, the tones "D", "C" and "A" forming a passing chord. Line two shows the third melody note, "F♯", harmonized with the same two tones as before, "C" and "G". When combined, these three tones make an unpleasant sound comprising no chord at all but rather a tone cluster which has no harmonic function. The proper harmonization shown in line three includes the tones "D♯", "C" and "A" with the appoggiatura "F♯" as a passing chord. The fourth melody note, "G", is also present in the given harmony. In line two, only the tones "E" and "C" are added. The proper harmonization indicated in line three adds the tones "E", "C" and "A". Line two shows the tones "G" and "E" added to the fifth melody note, "D". The chosen configuration presents a cadencial feeling of repose which incorrectly sounds as if the song could end at this point. Line three shows the harmonization of the appoggiatura note "D" with the tones "B", "G" and "E" which avoids the cadencial feeling yet comprises a substitute harmony for the given harmony ("C" major). The sixth ("C") and seventh ("G") melody notes are harmonized in the same fashion as the first and fourth while the eighth ("G" flat or "F" sharp) is harmonized in the same fashion as the third melody note. Regarding the ninth melody note ("F"), a comparison of the second and third lines shows the omission of the "E", present in the given harmony, since it is incompatible with the melody note "F". Line two adds the tones "C♯", "A" and "G" whereas line three substitutes the tone "B" for the tone "A" and also adds the tones "C♯" and "G" to provide a richer sound. In accompanying the tenth melody note ("E"), line three includes the tone "A" instead of "B".

Present-day automatic harmonization systems are thus limited musically by their inability to utilize advantageous non-chordal or non-scale tones when these notes are not explicitly sounded by the musician. This inability becomes particularly critical when a musician of limited ability and/or dexterity seeks to sustain an accompanying chord with only a minimum number of tones. In such instances, chordal tones selected to accompany the melody will occasionally provide only a simple and plain sound, not always musically correct, including potential tonal skips or dissonant combinations, when played on present-day orchestration control systems. Thus, while the aforementioned systems have advanced the art by expanding the playing range of many musicians, they still do not incorporate some significant aspects of musicianship and do not derive the accompaniment notes on the basis of harmonic relationship between the melody and the selected chord.

Melody notes not contained within the tones of the chord defined by the accompaniment are referred to as "passing tones". As is the case in the above example, most melodies contain some notes which are not tones of the selected chord. The passing tones may be either non-chordal or non-scale with respect to the harmony defined by the accompanying chord. These passing tones are, however, intimately tied both to the melody and to the harmony; the existence and definition of such a harmonic relationship is necessary for selecting appropriate accompaniment notes to augment the melody.

The table below, presenting a set of tonal relationships, illustrates these musical principles. It lists appropriate accompaniment notes for a major chord having a root of C. Each of the twelve columns of the table corresponds to an indicated melody note. Thus, if the melody note selected is F, a musically proper set of accompaniment notes for a major chord having root C is D, C, A, and F, selected from column 6 of the table.

TABLE 1

| | C Major With Added Notes | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| | C | C# | D | D# | E | F | F# | G | G# | A | A# | B |
| (1) | A | A# | B | C | C | D | D# | E | E | G | G | G |
| (2) | G | G | G | A | A | C | C | C | C | E | E | E |
| (3) | E | E | E | F# | G | A | A | A | A# | C | D | C |
| (4) | C | C# | D | D# | E | F | F# | G | G# | A | A# | B |

Accordingly, a skilled musician appreciates that a different chord type, such as minor or seventh, will result in different accompaniment note combinations, as reflected in each of the melody note columns. In addition, he knows that each of the five chord types will vary according to the style of voicing desired, resulting in a different proper set of accompaniment notes, for each melody note and chord type. For this reason, there exists a separate set of five tables (one table for each of the chord types—major, minor, seventh, augmented and diminished) containing appropriate accompaniment notes for each of the common styles of voicing: open (three-note or four-note), closed (three-note or four-note), block, duet (country or common) and hymnal.

The desirability of selecting a group of accompaniment notes from a table as above, the table being derived on the basis of the harmonic relationship between the melody and the selected chord, is evident from the preceding musical discussion. However, disregarding for the moment the complications added when one desires a variety of voicing styles, the use of such a method occasions a difficult-to-manage information storage and retrieval problem. Since there are five possible chord types and twelve possible roots for each of twelve melody notes, 720 ($5\times12\times12$) memory locations are required to store each set of four accompaniment notes (certain voicing styles may require more or less than four accompaniment notes for optimal harmony) for each style of voicing.

In accordance with the present invention, a method and apparatus are provided for enhancing the musical quality of a piece as played by a performer on an electronic musical instrument by introducing harmonious accompaniment notes selected without being limited to tones of a "recognized" chord, and without being limited to a predetermined compass beneath a "recognized" melody note, using minimal hardware and storage capability for practical implementation; the apparatus incorporates significant additional musical features including voicing style selectivity and a selective orchestration capability.

More particularly, there is provided in one of its aspects a method for embellishing a melody represented by the actuation during a time frame of one or more playing keys of a musical instrument keyboard capable of representing a plurality of notes. The invention defines a method including the selection and recognition of at least one chord. At least one accompaniment note is then derived from the harmonic relationship of said melody to said chord. The melody and accompaniment notes are then sounded to produce an embellished melody.

In a further aspect, the present invention comprises a method for deriving a signal representative of at least one accompaniment note chosen according to melody and harmony. In this aspect, melody and harmony signals are generated that are responsive to the actuation of the keys of a keyboard. A plurality of listings of harmonious accompaniment notes, stored according to musical chord type, is addressed to locate at least one accompaniment note in accordance with the chord root and the melody note. An accompaniment note signal is then generated responsive to the located accompaniment notes.

In a third aspect, apparatus is provided for sounding at least one accompaniment note. The apparatus includes means for generating signals responsive to both melody and harmony. Additionally, there is provided means for storing at least one accompaniment note and for locating the accompaniment note and generating a signal responsive thereto. Finally, means are provided, responsive thereto, for sounding the selected accompaniment note.

These and other objects, advantages and features of the present invention will appear for purposes of illustration, but not of limitation, in connection with accompanying drawings wherein like numbers refer to like parts throughout and wherein:

DETAILED DESCRIPTION OF THE INVENTION

Figure 1:
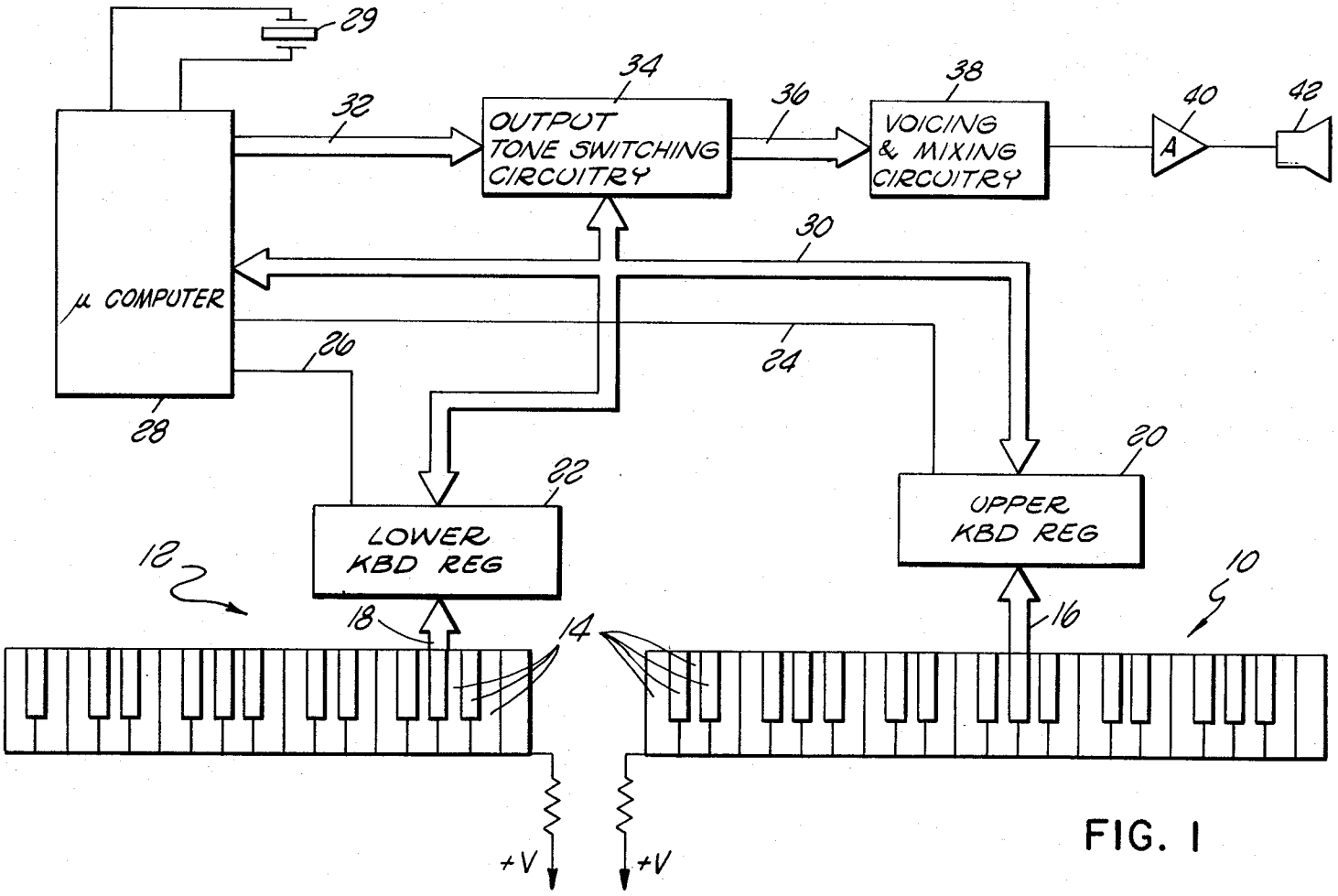
FIG. 1 is a system schematic view of the present invention.

Referring now to the drawings, FIG. 1 is a diagram of an electronic organ system incorporating the present invention. In it, an upper ("melody") keyboard 10 and a lower ("harmony") keyboard 12 provide conventional means for playing the instrument (i.e., for manipulation according to the techniques of musicianship) and for the application of data to the system. The data is then processed according to the methods of the present invention which incorporate the musical principle of transposition. Keys 14 are arranged to correspond to standard musical scales and are assigned ordinal numbers for data-processing purposes. Separate melody and harmony keyboards are provided according to FIG. 1. The present invention may also be practiced by means of an organ system utilizing a single keyboard. It will also be noted that the selection of harmony may be achieved by means of a conventional button-type chord selector. In the event such chord selection apparatus is employed, it will be appreciated that the chord detection or recognition apparatus and method disclosed infra may be bypassed in implementing the system herein.

A switch is associated with and activated by the application of pressure to a number of the keys 14. Each such switch assumes a first state and, upon the performer striking an associated keyboard key 14, a second, opposite state. In the embodiment of FIG. 1, wherein "low true" input logic is employed, the closing of such a switch by striking its associated key 14 causes the application of a positive voltage +V through a pull-up resistor to a preselected storage location in a shift register (as discussed in connection with FIGS. 2(*a*) and 2(*b*)) to cause the storage therein of a logic "zero".

The data generated by the manipulation of the keyboards 10, 12 is applied in parallel fashion over a melody bus 16 to the upper or melody keyboard register 20 and over a harmony bus 18 to the lower or harmony keyboard register 22. As will be discussed, the registers 20, 22, which are controlled by signals from a microcomputer 28, include shift registers for the storage of successive musical frames defined by the states of the sets of the switches associated with keys 14 depressed at a given instant of time. The frames of data are read out of the registers by the application of clocking pulses from the microcomputer 28. Each of the registers 20, 22 thereby provides playing data, in registration corresponding to the relative locations of the keyboard notes, to the random access memory (RAM) of the microcomputer 28 by means of serial bit streams transferred along a melody conductor 24 and a harmony conductor 26. A timing crystal 29 aids the various functions of the microcomputer 28.

A preferred embodiment of the present invention utilizes an Intel 8048 microcomputer, a programmable device manufactured by the Intel Corporation of Santa Clara, Calif. A detailed discussion of the system operation of the microcomputer 28 will be undertaken with regard to FIGS. 4(*a*) and 4(*b*). For the present, it will suffice to say that the microcomputer 28 is specifically adapted in the present invention to control the various functions of the organ system and, in particular, to gather and process musical data to generate the appropriate accompaniment which adds texture to the pitches selected by the musician.

Figure 6:
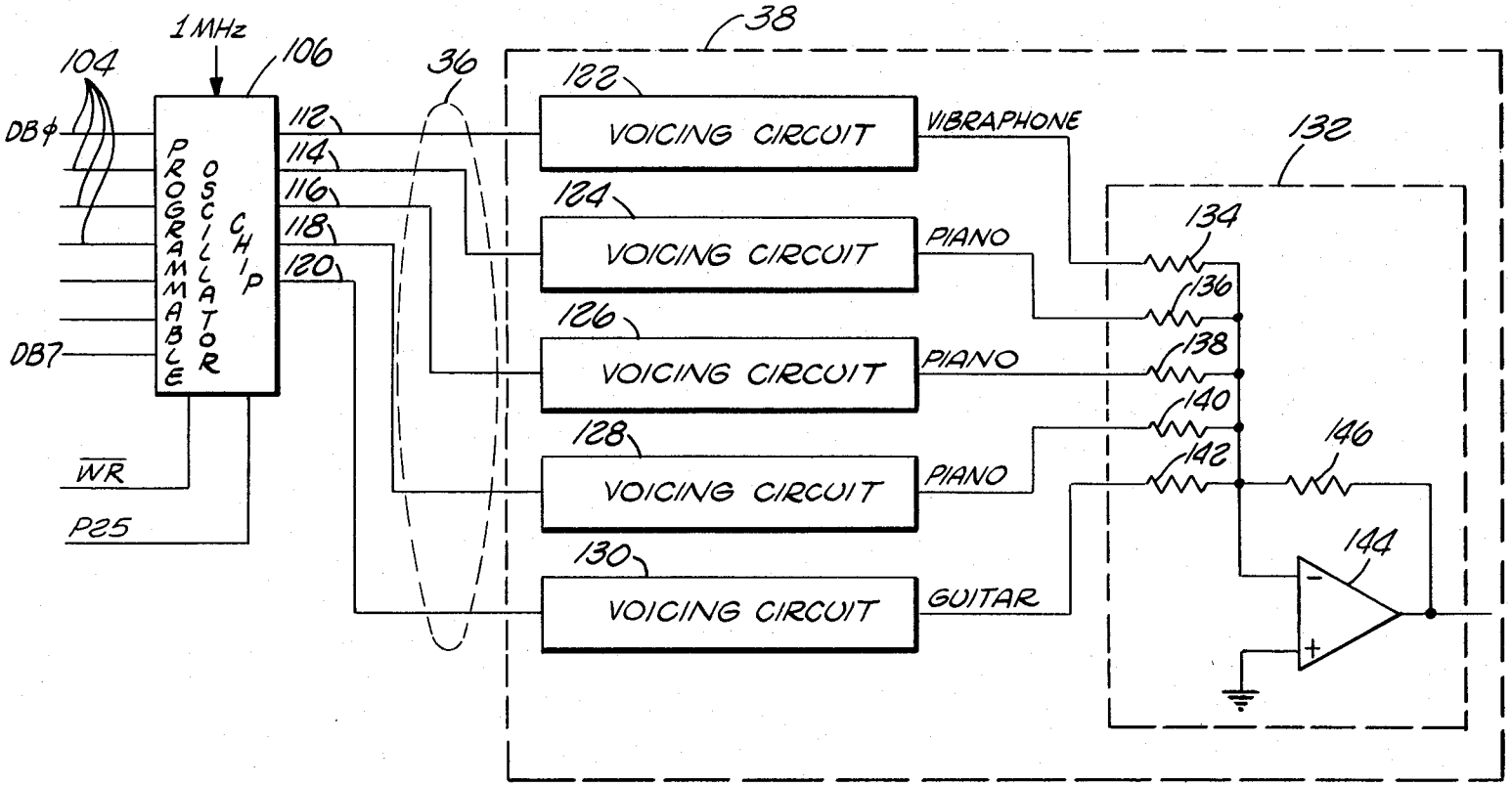
FIG. 6 is a schematic diagram of an alternative embodiment of the output circuitry of the present invention. The circuitry of this figure incorporates an orchestration capability into the system of the present invention.

Data representative of the accompaniment notes generated is provided to output tone switching circuitry 34 by the data bus 32. The output tone switching circuitry 34, which is controlled by the microcomputer 28, includes alternative embodiments illustrated in FIGS. 3 and 6 comprising further novel features of the invention. In the embodiment of FIG. 6, an orchestration capability is achieved. After processing within the output tone switching apparatus 34, resultant analog signals are applied along a bus 36 to voicing and mixing circuitry 38. The circuitry 38 provides an analog waveform for an amplifier 40 which, in turn, feeds the amplified analog signal to a conventional speaker or speaker system 42 to sound the desired music.

Figure 2A:
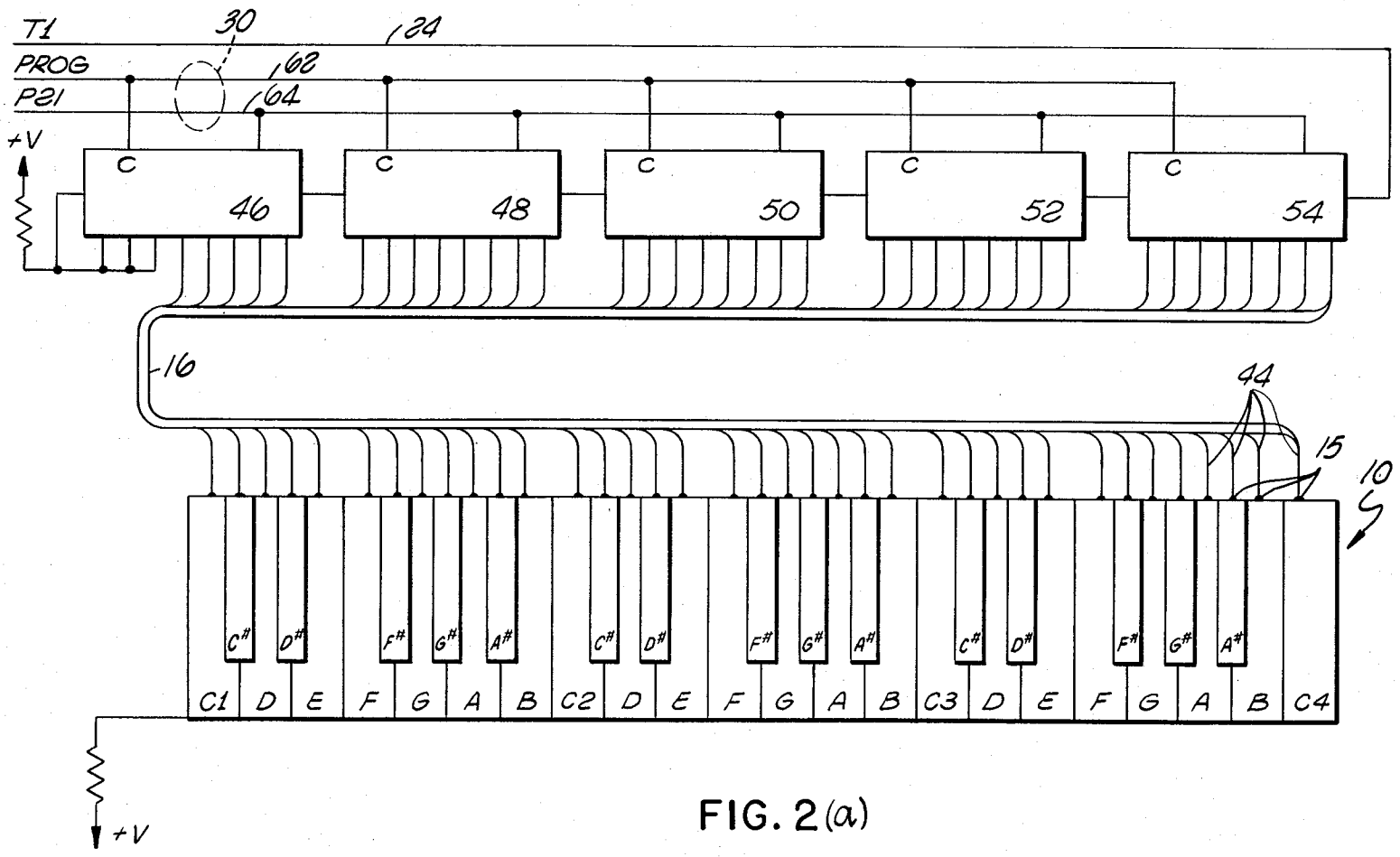
FIGS. 2(*a*) and 2(*b*) present schematic diagrams of the upper or melody and the lower or harmony keyboard input circuitry, respectively, of the present invention.
Figure 2B:
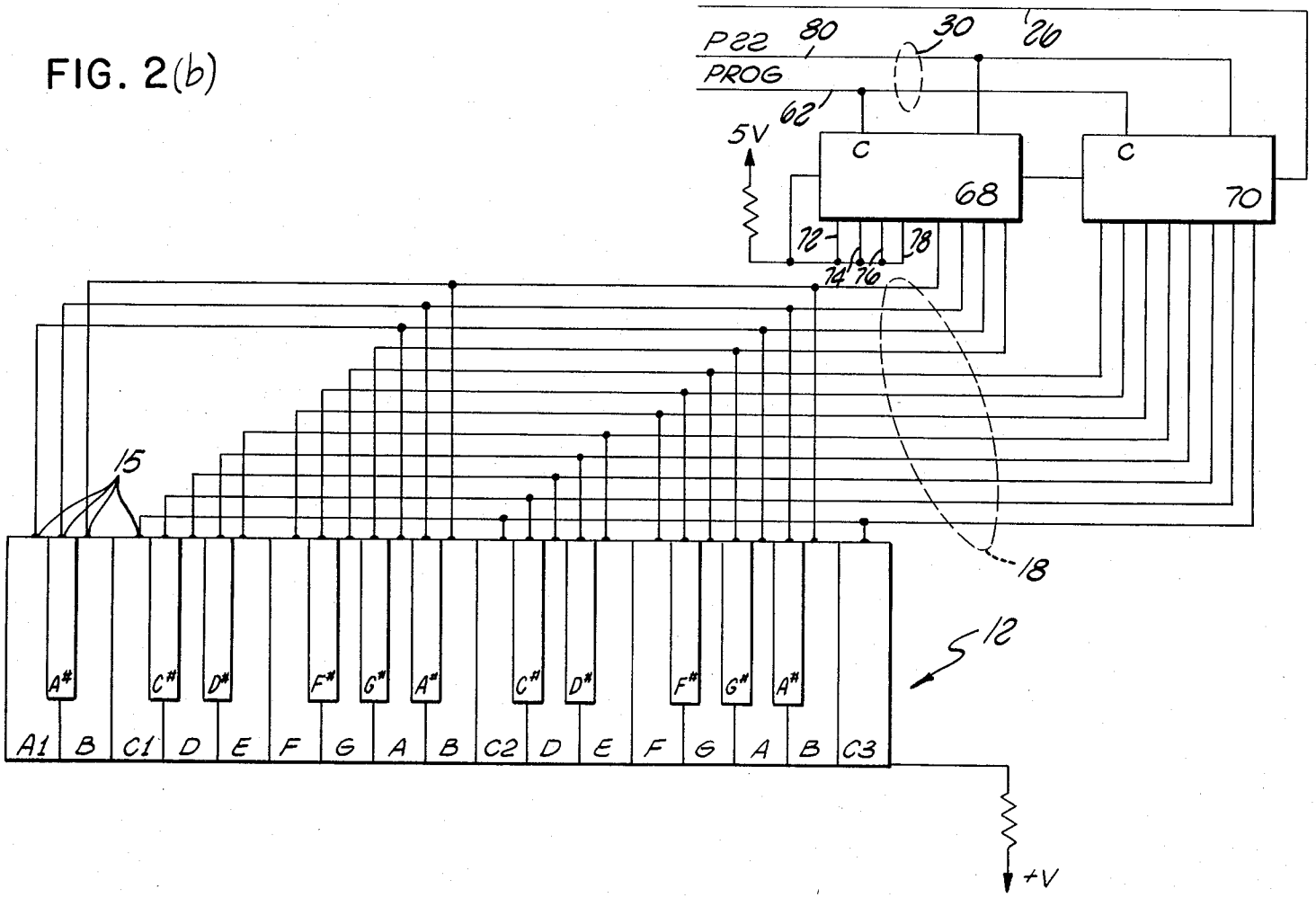

FIGS. 2(*a*) and 2(*b*) present in greater detail the input (melody and harmony) systems of the organ. In FIG. 2(*a*), the upper ("melody") keyboard circuitry, it can be seen that the upper keyboard register 20 includes a plurality of shift registers 46, 48, 50, 52, 54 which communicate with the melody keyboard 10 via the melody bus 16. A plurality of conductors 44, provides electrical connection between a positive voltage, +V, common to each of the keys 14, and an associated location of one of the selected shift registers 46–54 through a corresponding plurality of key-activated switches 15. It will be noticed that the melody keyboard 10 includes only 37 keys. This reflects the fact that, although the standard spinet organ keyboard includes 44 melody keys (F1 through C4), the lower seven keys (i.e., F1 to B1) are not sampled to allow, in the invention, the sounding of a number of accompaniment notes below all melody notes processed. Thus the accompaniment generation technique of the present invention is not responsive to the potential depression of these lower-scale melody tones, and does not "recognize" those tones as melody input for accompaniment purposes. As a reflection of the limited melody input from the keyboard 10 and the utilization of five eight-bit shift registers (each of which may be, for example, a DC 4014B manufactured by the Radio Corporation of America of Princeton, N.J.) the first three locations of the register 46 are tied to a common positive voltage which, for the "low true" input logic employed, corresponds to a logic "zero".

The control bus 30 applies clocking and latching functions to the upper keyboard registers along conductors 62 and 64, respectively. A clock pulse is applied to the registers upon the completion of each melody note computation cycle of the microcomputer 28 (discussed infra). Its application enables the registers 46–54 to retain the data input from the keyboard 10 until forty-four clock pulses have arrived from the microcomputer 28 to read an entire frame of melody data into the microcomputer.

FIG. 2(*b*) is a detailed illustration of the lower ("harmony") keyboard input circuitry. The harmony keyboard 12, the output of which is utilized to identify the chordal-type selected by the musician, also includes a plurality of switches 15, each associated with a single note, for connecting a positive potential +V to preselected locations of shift registers 68, 70 which comprise the lower keyboard register 22. The organ utilizes a harmony keyboard 12 of twenty-eight keys. Unlike the situation discussed with respect to the melody keyboard 10, it can be seen that the twenty-eight outputs of the keyboard 12 are cross-connected in a reducing matrix 66 so that the harmony bus 18 applies only twelve independent, parallel outputs to the registers 68, 70. Corresponding thereto, the first four inputs 72, 74, 76, and 78 of the eight-bit shift register 68 are wired directly to a positive voltage, storing logic "zero's" in the corresponding shift register locations.

Thus, although the harmony keyboard 12 comprises twenty-eight tones arranged in order of ascending frequency, left to right, from the lowest tone (A1) to the highest tone (C3), the reducing matrix 66 assures that the content of the shift registers 68, 70, comprising the lower keyboard register 22, will not reflect the octaval origin of the applied tones. Such simplifaction of circuitry eliminates harmonically redundant information from the data input of the system. It will be apparent to those skilled in the art that this simplification of data consequently reduces the electronic complexity of the device. The discarding of octave information with respect to the harmony keyboard's input is permitted since chordal identification or recognition as to both type and root is independent of octave when determined according to the teachings of the present invention and those of U.S. Pat. No. 4,248,118 of George R. Hall and Robert Hall, for "HARMONY RECOGNITION TECHNIQUES", the teachings and content of which are hereby incorporated by reference.

As was the case with respect to the upper keyboard register 20, the shift registers 68, 70 of the lower keyboard register 22 receive control signals from the microcomputer 28 by means of the control bus 30. More particularly, the clock line 62 and the latch line 80 control the shift registers 68, 70 in a fashion analogous to the control of the upper keyboard register 20 by the microcomputer 28. The clock line 62 provides identical clocking to the shift registers of the upper and the lower keyboard latches while the melody and harmony shift registers are individually latched by signals carried along the conductors 64 and 80.

Figure 3:
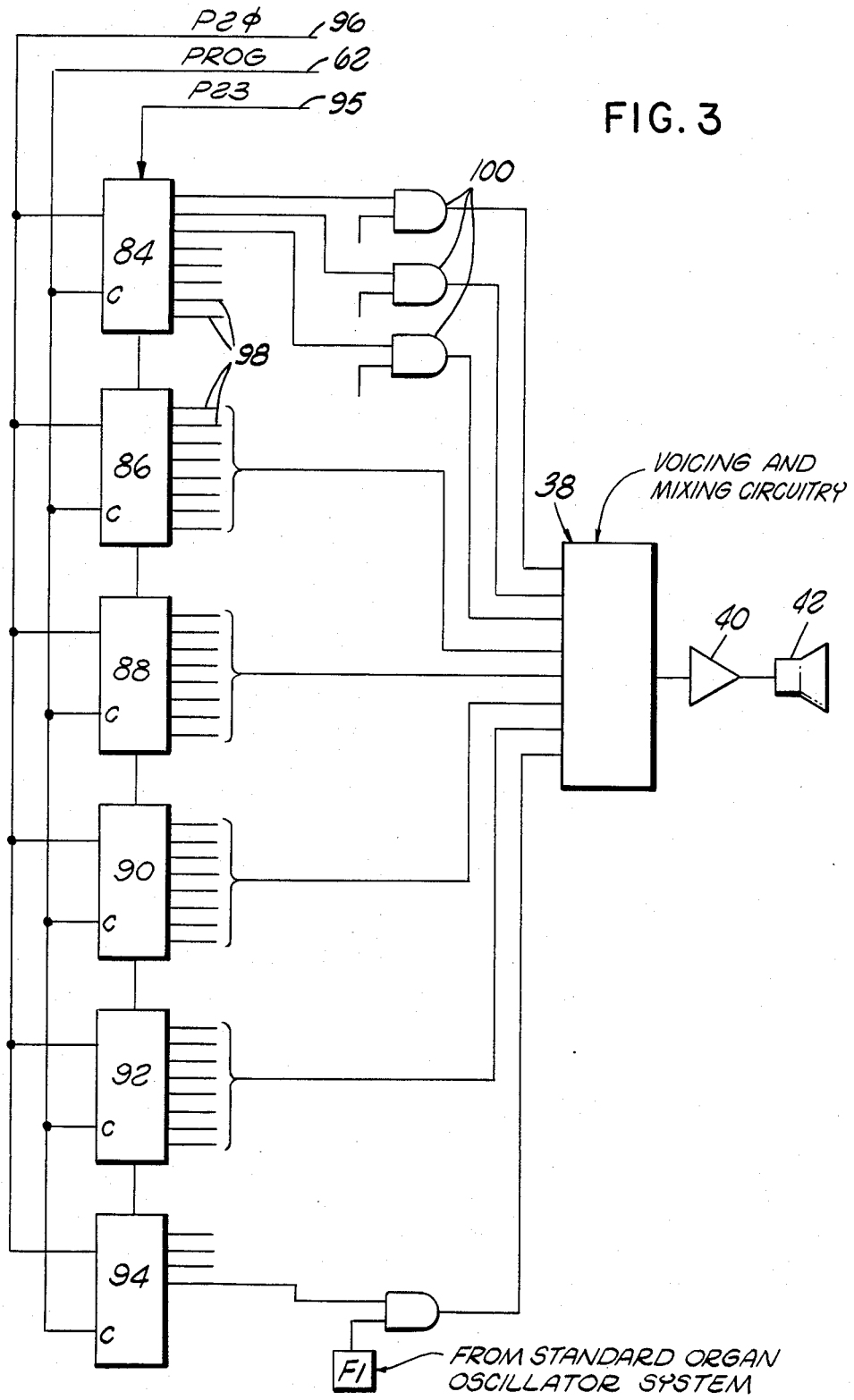
FIG. 3 is a schematic diagram of a first embodiment of the output circuitry including output tone switching apparatus and voicing and mixing circuitry of the present invention.

Referring now to FIG. 3, there is shown a detailed schematic view of output circuitry according to the present invention. It includes the interacting output tone switching circuitry 34, voicing and mixing circuitry 38, output amplifier 40 and speaker 42 disclosed in FIG. 1.

Figure 5:
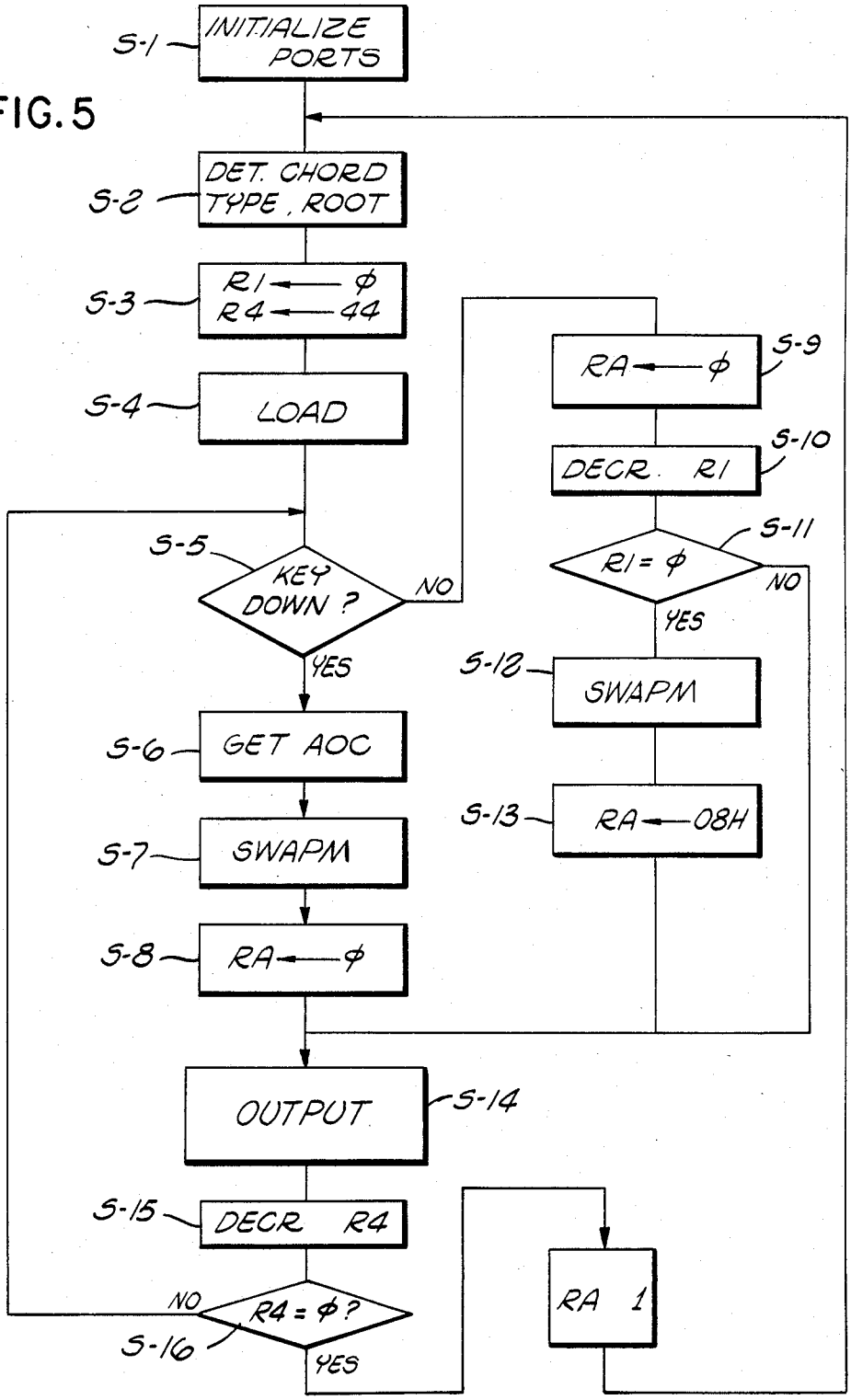
FIG. 5 is a flow diagram illustrating the operations and computations utilized by the present invention.

The output tone switching circuitry 34 includes six eight-bit serial-to-parallel converters 84, 86, 88, 90, 92, 94, the last four locations of which are unresponsive to incoming data. Each of the converters 84–94 may be a CD 4094 manufactured by the Radio Corporation of America, essentially a combination shift register and buffer-latch. A stream of forty-four bits of data, generated by methods to be discussed, is clocked along the conductor 95, which provides electrical connection between the converter 84 and the microcomputer 28, into the forty-four utilized locations of the six eight-bit converters. The bits are clocked into the converters 84–94 by the PROG clocking pulses of the microcomputer 28 which are applied along the conductor 62. Each PROG pulse is toggled by the execution of an "OUTPUT" instruction within the microcomputer 28. Hence, it will be seen, each bit of data generated by the method shown in FIG. 5 is appropriately clocked into the converters 84–94. A latching pulse, provided through the conductor 96, initiates the "dumping" of the data, which has been clocked serially into the converters, along forty-four parallel conductors 98. The latching signal is generated upon the affirmative interrogation of a loop counter (the countdown register R4 of the Intel 8048 microcomputer, discussed infra). Affirmative interrogation indicates a system determination that all thirty-seven melody notes of the input have been processed. (Although there appears to exist a discrepancy between the length of the input melody keyboard 10 and the number of tones generated by the output circuitry, one must keep in mind the fact that derived accompaniment notes supplement the tones "called up" by the playing of the input keyboards.)

The forty-four parallel outputs applied to the conductors 98 represent forty-four independent keying signals. Each keying signal is in turn applied to an AND gate 100, the other input port of which is tied to one of forty-four tones generated from a standard organ oscillator system (not shown). The keying pulses applied to the AND gates 100 pass the tones therethrough. Each output of an AND gate, a single frequency analog voltage signal conveying one musical pitch, is applied to the conventional, homogeneous voicing and mixing circuitry 38. The circuitry 38 includes standard organ filters and related mixing circuitry, by means of which the individual keyed tones from the AND gates 100 retain tonal integrity as they are combined into a composite signal. The resultant signal is applied to the output amplifier 40 and finally to the speaker 42 which acts as an electro-audio transducer, translating the analog signal into sound.

Figure 4:
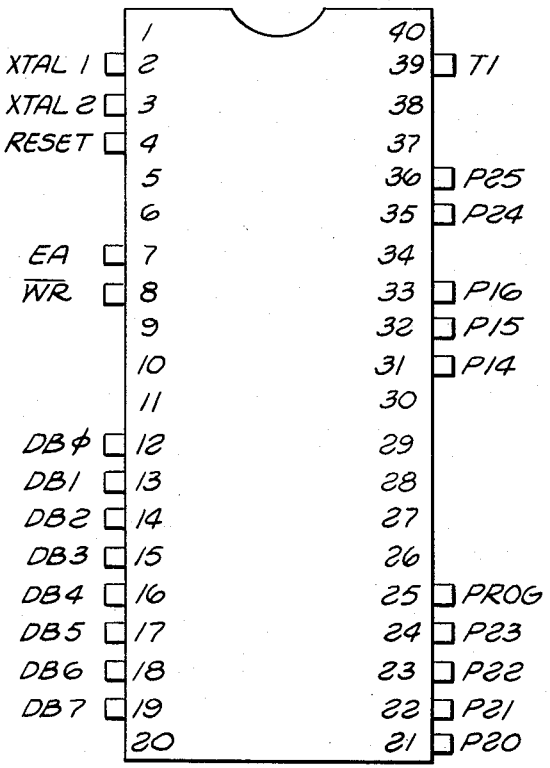
FIGS. 4(*a*) and 4(*b*) present a logical schematic and a pin diagram, respectively, of the microcomputer of the present invention, showing the microcomputer functions and pins utilized in the present invention.
Figure 4:
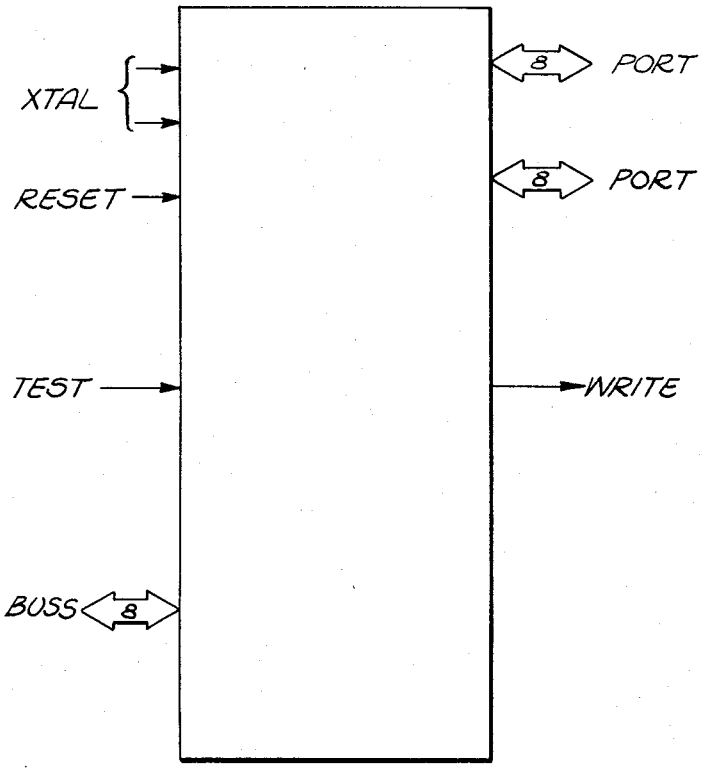

FIGS. 4(*a*) and 4(*b*) are detailed illustrations of the microcomputer 28 which supplies the various control functions of the present invention. FIGS. 4(*a*) and 4(*b*) use the nomenclature of the Intel 8048 microcomputer chip utilized in a reduction to practice of the present invention. In the event a more general appreciation of the details of this machine and its functions may be desired, one can refer to *MCS*-48 *Microcomputer User's Manual* published by the Intel Corporation of Santa Clara, Calif. (1976). This invention is by no means limited in implementation to this particular microcomputer 28 nor, in fact, to any device, programmable or otherwise, as a control mechanism. Extensive reference to the Intel 8048 is made only for the purpose of illustration and as a basis for reference to the interworkings of the programming scheme illustrated in FIG. 5. The scheme of that figure discloses the control method used in the actual implementation of the present invention by means of an Intel 8048 and incorporates corresponding component designations of such microcomputer including its registers and the like.

FIG. 4(*a*) presents the logical functions of the eight-bit Intel 8048 single component microcomputer which relate to the invention. FIG. 4(*b*) illustrates the pin configuration of the Intel 8048 employed in an actual reduction to practice of the present invention.

Referring concurrently to the above-referenced figures and proceeding down the left-hand side of the logic diagram of FIG. 4(*a*), it is seen that the crystal input for the internal oscillator of the microcomputer is connected across the second and third pins of the computer chip. The microcomputer 28 is initialized by the application of a $\overline{\text{RESET}}$ signal generated in an RC circuit which communicates with its fourth pin. The melody conductor 24 transfers the aforementioned stream of melody bits to the thirty-ninth pin, a testable input (T1). The bit state at this pin reflects the state of the rightmost location of the shift register 54 of the melody input latch 20.

The twelfth through nineteenth pins locate an eight-bit data bus which provides a frequency "divisor" to the alternative output configuration illustrated in FIG. 6. This bus is not utilized when the output configuration of FIG. 3 is employed.

Port 1 of the microcomputer 28, a "quasibidirectional" port, provides three pins (of eight), the thirty-first, thirty-second and thirty-third, engaged to style selectable keyboard apparatus (not shown). Such apparatus, comprising a relatively simple switch of conventional design well known in the art, enters a three-bit number into the accumulating register RA of the microcomputer 28. The number is utilized in the present method to allow the performer to select a preferred voicing style. For any of up to eight voicing styles, there is provided a set of five tables, the content of each table of such set varying according to the style selected. The five tables refer to five different types of chords. The voicing styles, such as open (three-note or four-note), close (three-note or four-note), block, duet (country or common) and hymnal, reflect relationships between the melody and harmony of a piece of music and, by varying the style selected, the performer may vary its melodic emphasis.

Port 2 is a second quasi-bidirectional port. Five of the eight components of port 2, accessed at the twenty-first through twenty-fourth and thirty-fifth pins of the microcomputer 28, are utilized. The pins communicate, respectively, with the output latching conductor 96, the melody input latching conductor 64, the harmony input latching conductor 80, the output conductor 95 and the melody input conductor 24. It may be noted that the port as utilized is clearly bidirectional, in that it both accepts data along the conductor 24 and transfers data out of the microcomputer 28 along the conductor 95.

The eighth and thirty-sixth pins of the chip provide means for communicating addressing signals to a programmable oscillator chip, the data input of which is addressed through the pins of the eight-bit data bus, discussed supra. The data bus forms a significant element of the alternative output configuration of FIG. 6.

Utilizing the apparatus disclosed in the preceding figures, there is employed in the present invention a data-processing method including various program steps stored in the internal program ROM of the microcomputer 28. The program steps, by means of which the system processes and operates upon keyboard data to generate various control signals and functions, embody a method for deriving, from the input harmony and melody data, a number of accompaniment notes, the sounding of which will be harmonious with and will enhance the melody selected by the musician.

In the present invention, the musical principle of transposition, based upon the regular progression of frequencies throughout the equally-tempered scale and the doubling of frequencies from octave to octave, enables the extraction of complex harmony from a limited information storage system. Stated simply, the principle of transposition, recognizing the regularity within musical scales, permits one to obtain the same order of harmony tones obtained when one combines a first melody note with a chord having a first root (melody note and root not necessarily the same note) by sounding a second melody note with a chord having a second root *provided* all the accompaniment notes employed in the first instance are shifted in the same direction on the scale by the number of tones that separates the second chord root from the first chord root. Based upon this principle, and in accordance with the present invention, there is derived a set of five chord type tables, each of the tables containing a set of numbers representing the musical-scale *relationships* of the accompaniment notes. Each of the five tables, as mentioned above, was derived on the basis of the harmonic relationship between the twelve melody notes and the chord. By arbitrarily assigning the value "one" to a specific note of the musical scale, the values of the table may be subsequently adjusted for a different chord root according to the preceding teaching. For example, below is the table for a major chord:

TABLE 2

| | C Major With Added Notes | | | | | | | | | | | |
|---|---|---|---|---|---|---|---|---|---|---|---|---|
| C | 1 | 2 | 3 | 4 | 5 | 6 | 7 | 8 | 9 | 10 | 11 | 12 |
| (1) | 10 | 11 | 12 | 1 | 1 | 3 | 4 | 5 | 5 | 8 | 8 | 8 |
| (2) | 8 | 8 | 8 | 10 | 10 | 1 | 1 | 1 | 1 | 5 | 5 | 5 |
| (3) | 5 | 5 | 5 | 7 | 8 | 10 | 10 | 10 | 10 | 1 | 3 | 1 |
| (4) | 1 | 2 | 3 | 4 | 5 | 6 | 7 | 8 | 9 | 10 | 11 | 12 |

Assigning the value "one" to note C, and adding "one" for each successive chromatic semitone, starting over at twelve, one can see that the appropriate accompaniment notes for melody note D (column 3 of the table) are numbered 12, 8, 5 and 3. These correspond to the notes B (note 12 with respect to C), G (note 8 with respect to C), E (note 5 with respect to C) and D (note 3 with respect to C). In the event that the root of the chord was F (note 6 with respect to C), rather than C, the appropriate notes for D could be determined by shifting the values of the notes in column 3 by an amount equal to the shift in the chord root. Since the note F is five above the note C, the table above would be transposed by adding five to each accompaniment note value. The new values in column 3 would then be 5, 1, 10 and 8.

Figure 7:
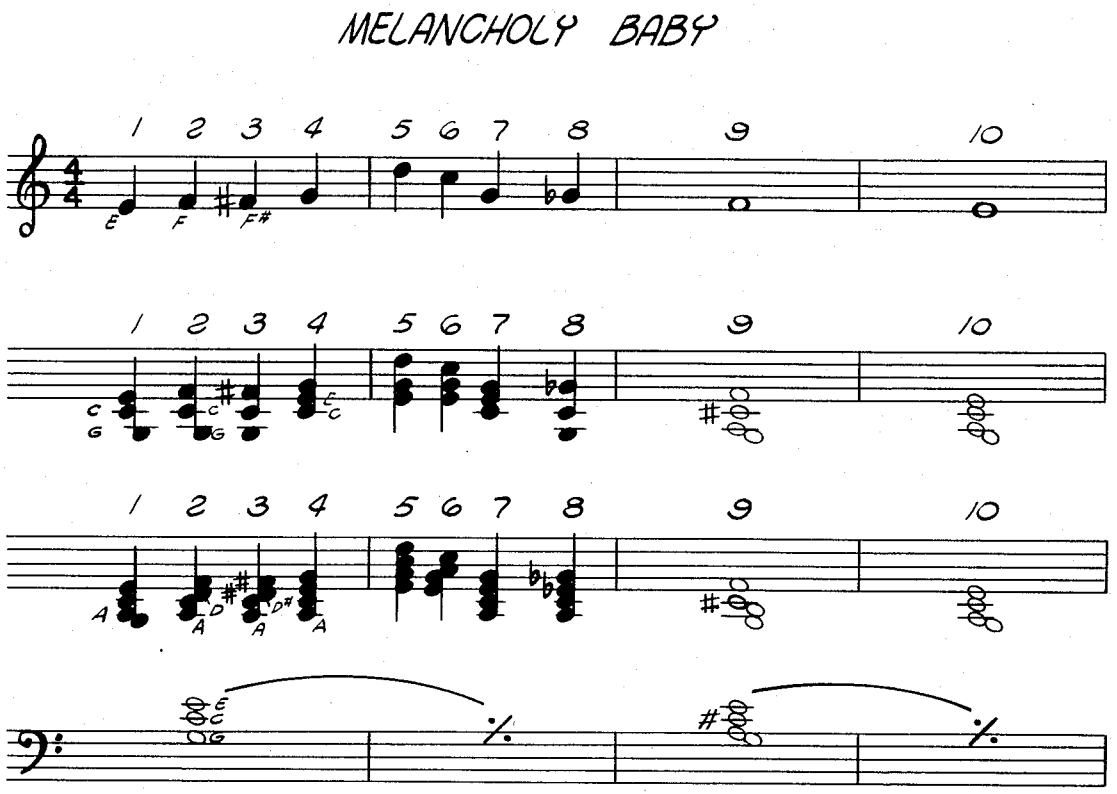
FIG. 7 illustrates, by way of comparison, the musical limitations of prior-art orchestration control (second set of lines from top) in the harmonization of a portion of the music to "Melancholy Baby."

In accordance with the invention, one applies the above musical verity to reduce the complexity and information storage capacity otherwise required of a system capable of selecting accompaniment notes for optimum harmony. The application of this principle to electronic musical instrumentation allows practical implementation of highly enhanced automated orchestration control as shown in FIG. 7. By designing accompaniment note tables as above, readily amenable to mathematical transposition based upon the underlying musical fundamentals, and by performing the transposition in light of the melody and harmony recognized by the machine (i.e., identified from the depression of keyboard elements), one need only utilize $12 \times 5$ or 60 storage locations, a relatively manageable situation as contrasted with 720, for the sets of accompaniment notes.

The method of the present invention involves essentially the retrieval and output of one column of data or notes from one table of a set of five (corresponding to five basic chord types) stored in a ROM of the microcomputer 28. The musician, by depressing the keys of the melody and harmony keyboards, provides input data for deriving the address of the proper column of accompaniment notes. Additionally, there exist a number up to eight, of separate sets of five tables each, the choice of which is dependent upon the voicing style desired by the player. As mentioned earlier, the player may input into accumulation register RA of the microcomputer 28 a three-bit word which will result in the addressing of a column of notes appropriate, not only for harmonious accompaniment, but also reflecting the musician's desired tonal emphasis.

FIG. 5 describes the accompaniment note selection routine of the program instructions stored in the ROM of the microcomputer 28. Briefly, the proper accompaniment notes are located by a column-addressing technique based upon musical transposition.

The computation is initialized when power is applied to the circuit by application of a $\overline{\text{RESET}}$ pulse to the fourth pin of the microcomputer 28 from an RC circuit. In step S-2, the harmony data of the lower keyboard latch 22 is clocked out of the shift registers 68, 70 and applied to the thirty-fifth pin of the microcomputer by the conductor 82. The data of the serial bit stream is then scanned for chord type and root by a method such as that disclosed in U.S. Pat. No. 4,248,118 of George R. Hall and Robert Hall discussed above. In this method, playing key pattern representations are stored in a digital memory at locations having addresses defining the corresponding chord type. A playing key pattern signal identifying the pattern of the keys played by the performer is then generated and used to locate the corresponding stored playing key pattern representation. When a match occurs, the chord type and root are derived, i.e. recognized, by a processor.

After deriving and storing the relevant chord information, the microcomputer 28 proceeds to the processing of the melody data. In step S-3, the count of an eight-bit, downcounting register R1 is set to zero while the count of register R4 of the Intel 8048 is set to forty-four. R1 will be seen to store the location of the accompaniment information while R4 serves as a loop or melody note counter, indicating at all times the number of notes of the melody keyboard which remain to be processed.

The loading of data into the upper keyboard registers 46–54 is signalled by the application of a downgoing latch signal from the microcomputer (twenty-second pin) along the conductor 64 of the control bus 30. At the end of this step, forty bits of data have been loaded into the upper keyboard latch 20, the locations of individual bits therein corresponding to the relative locations of the notes of the upper keyboard 10.

Entering the computation loops, step S-5 examines the state of the bit located in the rightmost portion of the upper keyboard latch. This location, in communication with the thirty-ninth pin of the microcomputer, through the conductor 24, corresponds initially to the melody note C, octave 4 (note number forty-four). As successive clocking (PROG) pulses shift the data of the latch 20 rightward, notes to the left of this note are examined.

Assuming the interrogation of step S-5 does not disclose a depressed key, the method proceeds to step S-9. In S-9, a zero count is entered into accumulating register RA of the microcomputer 28. The entry of a zero into RA signifies the NOT TRUE condition. When this is followed by an "OUTPUT" command, the terminal interfacing the twenty-fourth pin will go low. (The "OUTPUT" command additionally toggles the PROG clock function so that the low state of the twenty-fourth pin is then clocked into the leftmost location of the converter 84 along the conductor 95.)

The register R1 is decremented in step S-10 and, in S-11, interrogated to determine whether its count has reached zero. The initial decrementing of register R1 changes its count from zero to two hundred and fifty-six. Later it will be shown that the count of R1 is altered by means of the subroutine SWAPM contained in lines 43 through 58 of the program listing of Appendix A, contained in the patented file of the instant application, but not reproduced herein.

Assuming that no accompaniment bits have yet been entered into R1 by SWAPM and that R1 has not yet been decremented to zero, the method then proceeds to step S-14, an "OUTPUT" instruction which directs the aforementioned clocking of a low state into the converter 84 in response to the "zero" count of the accumulating register RA. Loop counting register R4 is then decremented by one at step S-15 and interrogated at step S-16. The latter interrogation determines whether or not forty-four melody notes have yet been processed by the microcomputer 28. In the event that the count of the register R4 has, in fact, reached zero, a "one" bit is entered into the register RA and transferred to its twenty-first pin whence it is applied to the converters 84–94, "dumping" the keying data thereof into the plurality of AND gates 100.

Assuming that the interrogation at step S-16 has been negative, the routine returns to step S-5 and the state of the bit of data next shifted into the rightmost location of the melody shift register 54 by the toggling of a PROG pulse in step S-14 is examined. Assuming further that it is now determined that the new key is depressed, the method then proceeds to step S-6, a subroutine denominated GET AOC, the steps of which are contained in lines 130 through 650 of the program listing of Appendix A.

The GET AOC subroutine retrieves two bytes, each comprised of two four-bit nibbles of binary data defining a note. The bytes are arranged in a column of an accompaniment note table that is arranged according to and contains information as in Table 2. The table is stored in a ROM of the microcomputer 28. The bytes are stored in two registers (R5 and R6) of the RAM array of the microcomputer 28. Each number represents the interval from the last-named note of the table, going down columns and starting with the leftmost column. That is, if it were to be determined that the last note called out by the table were the note G, octave 3, then the number 5 as the succeeding entry in the table would correspond to the note located five tones to its left or D, octave 3. It will become apparent from the discussion to follow why intervals rather than absolute values are stored.

GET AOC initially locates and addresses the column which contains the four desired accompaniment notes. To do this, the subroutine employs modulo 12 addition of the difference between the number of the melody note whose depression was detected in the most recent step S-5 and the number of the chord root (which was determined in step S-2). Once the computation has been performed and there is derived the position of the depressed melody note relative to the chord root, it remains only to determine the table to enter. The determination of the table is a function, in the first instance, of the voicing style selected by the musician. As discussed supra, this decision is entered into the microcomputer 28 through the application of signals to the thirty-first through thirty-third pins by means of a keyboard switch or the like. The second determinant, chord type, is derived (step S-2).

The two bytes of information defining the four (or less, in the event that the particular voicing style calls for fewer than four) accompaniment notes located by the addressing of the table are stored in the eight-bit registers R5 and R6. The method of computation then proceeds to the subroutine SWAPM (step S-7) which transfers the rightmost four-bit nibble of the register combination R5, R6 into register R1. In addition, the remaining bits are shifted four register locations to the right and a zero count entered in the leftmost position. The program then proceeds to step S-8 wherein a zero count is entered into the accumulating register RA. (In the event the melody note is to be sounded in addition to the accompaniment notes, one would enter the hexadecimal 08H into RA to set up a "true" output.) In step S-14, an "OUTPUT" command shifts the zero count of the accumulating register to the twenty-fourth pin of the microcomputer 28 and toggles the PROG function to clock a low bit into the converter 84.

As before, register R4 is decremented to indicate the completed processing of the last melody note. After an interrogation at step S-16 determines whether the information in the comparators 84–94 may be "dumped", the routine returns to the interrogation of step S-5. Assuming that the next melody note (i.e., that to the left of the prior tested note) is not depressed, the method then proceeds to step S-9 wherein a zero count is loaded into RA in preparation for an output instruction. In step S-10, the register R1, which now contains, via SWAPM, a count equal to the rightmost nibble, corresponding to the first accompaniment note of the chosen column, is decremented by one. At step S-11, the count of R1 is interrogated to determine whether or not it has yet been decremented to zero. By induction, and observing the flow chart of FIG. 5, one can see that, assuming a second, closely spaced melody note does not interrupt the process by diverting the flow at step S-10 into the sequence of steps S-6 through S-8, additional zero or low output bits will be entered or clocked into the converter 84 via the steps S-14 through S-16 until such time as the interrogation at step S-11 yields an affirmative result. This affirmative result indicates that the count of register R1 has gone to zero. It is achieved after "zero" pulses, equal in number to the tone interval separating the first accompaniment note from the melody note, have been clocked into the counter 84 since the last affirmative interrogation at step S-5.

The program then proceeds to step S-12 where the SWAPM routine is again called forth. As before, the rightmost four-bit number representing the next accompaniment note is shifted by this subroutine into register R1 and the remaining two nibbles of the combined registers R5, R6 are transferred one four-bit nibble to the right. In step S-13, the hexadecimal 08H is entered into the accumulating register RA. This count indicates the outputting of a high or "one" bit when an "OUTPUT" command is given. The "OUTPUT" command and accompanying toggling of the PROG function occur at the next step, S-14. The command enters the high bit into the converter 84 at the completion of the entry of "zero" bits equal in number to the last accompaniment note contained in register R1. The process continues. One can see, by identical reasoning and analysis, that the loop will continue to return to the steps S-9 through S-13, assuming no interruption by the detection of an additional melody note at step S-5, clocking "zero" bits into the converter 84 equal in number to the latest interval shifted into R1 by SWAPM (step S-12). Should an interruption occur, the process would begin again with the new melody note from step S-5 and proceed as described above.

After the proper number of "zero" bits, a high output bit is clocked out following a positive interrogation at step S-11. Thus it can be seen that there will be clocked into the converters 84–94 a stream of digital data bits having "one" bit spacings which correspond to the numbers selected from the accompaniment tables. When all forty-four bits have been clocked into the converters, there exists a one-to-one relationship between the spacing of the locations within the converters 84–94 and the *intervals* stored within the transposition chord table. In addition, by setting a true instruction at step S-8, the melody note actually played by the musician will be entered into the stream of data bits and located with respect to the accompaniment notes. Thus, by assigning proper values to the locations within the converters 84–94, there is obtained a "one" bit or a "zero" bit in each location indicative of the preferred sounding or non-sounding of its associated tone.

FIG. 6 shows an output configuration which may be utilized as an alternative to that shown in FIG. 3. The arrangement includes an orchestration capability by means of which a number of instrument sounds may play the accompaniment notes derived by the method just illustrated.

Eight parallel conductors 104 comprising the data bus of the microcomputer 28 apply, in two separate loadings, a sixteen-bit divisor to a programmable oscillator chip 106. The chip 106 is a conventional device, the detailed operation of which is disclosed in *Service Manual: Model L*-15/L-5, publication number 993-030885 of Lowrey Organ Division of Norlin Industries, 707 Lake Cook Road, Deerfield, Ill. (September 1979). It is driven by a master oscillator having a frequency of, for example, one MHz for successful functioning within the present system. Internal to the chip are a number (five) of register-comparator-counter combinations. The register addressed retains the sixteen-bit divisor applied from the microcomputer 28 along the conductors 104. The counter keeps count of the number of cycles of the master oscillator, resetting upon a signal from the comparator when the count of the register is equalled. The reset pulses are repeated with a frequency equal to the frequency of the master oscillator divided by the count of the register (i.e., the divisor). Thus, by adjusting the value of the divisor, the frequency of the reset signal applied along one of five conductors 112, 114, 116, 118 and 120 that link the programmable oscillator chip 106 to the voicing circuitry of the output may be set.

The desired output tones are determined by the decoding of the accompaniment notes generated in FIG. 5. Once the note to be sounded has been decoded, it is a relatively simple matter to determine the proper divisor to deliver to the twelfth through nineteenth pins of the microcomputer 28. The subroutine PUT POP, the steps of which are contained in the program listing of Appendix A at lines 845 through 893, performs this relatively straightforward operation. The content of the bus is read into the programmable oscillator chip 106 by the interaction of a WRITE command from the microcomputer 28 to the corresponding input of the chip 106 via the conductor 108 and an ADDRESS/DATA command communicated to the chip 106 from the microcomputer 28 by means of the conductor 110. The loading operation is well known and discernible by those skilled in the art and familiar with the Intel 8048 and related devices. Similar devices may require a different sequence of functional steps to achieve the loading of data. Such sequences will, of course, be dependent upon the particular programmable oscillator chip 106 employed.

Each of the five tones produced by the chip 106 is transferred by one of conductors 112, 114, 116, 118 and 120 to five individual voicing circuits 122, 124, 126, 128 and 130, each of which utilizes filters and envelope circuitry to convert a frequency input into a musical instrument simulation. Thus, an arranger may, by means of the output apparatus of FIG. 6, select an orchestral arrangement (i.e., determine which instruments will play in which octaves and/or be used at all) for playing the melody and derived accompaniment.

The shaped frequencies emanating from the voicing circuits 122–130 are combined and mixed into a composite analog waveform in mixing circuitry 132 comprising the resistors 134, 136, 138, 140 and 142 in combination with the differential amplifier 144 with associated feedback resistor 146. The output of the operational amplifier is then applied to the output amplifier and speaker or speaker system disclosed in FIG. 1 to produce the orchestrated sound.

Thus it is seen that there has been brought to the musical instrumentation art a new and improved method and apparatus for its practice by which musical texture can be added to the notes selected by the musician. A performer utilizing methods and apparatus according to the present invention is not limited to either a preselected melody compass or to the harmony tone selection in the range of accompaniment notes available to him. The invention allows the performer to increase the complexity of melody available without multiplying the complexity of the automatic fill in process to the point of impracticability. Rather, by relying upon the underlying principle of musical transposition, the present invention allows the achievement of the aforesaid desirable advantages in a practical manner.

What is claimed is:

1. A method for embellishing a melody represented by the actuation during a time frame of one or more playing keys of a musical instrument keyboard, which instrument is capable of sounding at least one chord selected during the time frame, said method comprising the steps, accomplished by the instrument itself, of:

recognizing at least one note of the melody during the time frame;

recognizing a chord selected during the time frame;

deriving, for at least one note of the melody, at least one accompaniment note which is not a tone of the recognized chord and yet is harmonically related to said melody note and the recognized chord; and sounding said melody note and said at least one accompaniment note to produce an embellished melody.

2. A method as defined in claim 1 further characterized by the steps of:

providing a plurality of sets of tonal relationships, each of said sets associated with a musical chord type and containing a listing of at least one accompaniment note harmonically related to each melody note of the musical scale;

selecting a set according to the type of said recognized chord; and obtaining said at least one accompaniment note from said set with reference to the recognized melody note.

3. A method as defined in claim 2 wherein the type of said chord is derived from at least one harmony note defined by the actuation during said time frame of one or more playing keys of said musical instrument keyboard.

4. A method as defined in claim 3 additionally including the step of deriving the root of said recognized chord.

5. A method as defined in claim 2 or 4 wherein the step of obtaining said at least one accompaniment note comprises the step of transposing said set so that said at least one accompaniment note is harmonically related to the melody note for the type and root of the recognized chord.

6. A method as defined in claim 5 wherein the transposing step comprises:

defining a relationship between said melody note and said root; and, locating the accompaniment notes according to said relationship.

7. A method as defined in claim 6 wherein the step of defining a relationship between said melody note and said root comprises the step of performing modulo 12 addition of the difference of said root from a base root to said melody note.

8. A method as defined in claim 6 wherein said locating step comprises addressing said set in accordance with the relationship of the melody note and the chord root.

9. A method as defined in claim 2 wherein the providing step includes the step of providing a plurality of groups of sets of tonal relationships, each of said groups corresponding to a predetermined voicing style.

10. A method as defined in claim 9 in which said set of tonal relationships is selected from a group chosen in accordance with a predetermined voicing style.

11. A method as defined in claim 1 wherein said sounding step comprises orchestrating a predetermined musical sound.

12. A method for deriving a signal representing at least one accompaniment note chosen for musical qualities in relation to a given melody note and chord type and root, said melody and chord type and root represented by the actuation of one or more keys of a musical instrument keyboard capable of representing a plurality of notes, said method comprising the steps of:

generating a melody signal responsive to the actuation of at least one melody note during a predetermined time interval;

generating a harmony signal responsive to the actuation of at least one harmony note during said predetermined time interval;

storing a plurality of tables, each table comprising listings of accompaniment notes harmonically related to each melody note of the musical scale with respect to a musical chord type there being one table per chord type;

deriving a root and chord type from said harmony signal; then storing said root and type;

selecting a listing according to said chord type; and locating in said listing at least one accompaniment note according to said chord root and melody note; and then generating an accompaniment note signal responsive to said at least one accompaniment note located.

13. A method as defined in claim 12 wherein said storing step comprises the step of entering said listings into the memory of a programmable device.

14. A method for deriving a signal representing at lesat one accompaniment note chosen for musical qualities in relation to a given melody note and chord type and root, said melody and chord type and root represented by the actuation of one or more keys of a musical instrument keyboard capable of representing a plurality of notes, said method comprising the steps of:

generating a melody signal responsive to the actuation of at least one melody note during a predetermined time interval;

generating a harmony signal responsive to the actuation of at least one harmony note during said predetermined time interval;

storing a plurality of listings of accompaniment notes harmonically related to each melody note of the musical scale with respect to musical chord type, by entering the listings into the memory of a programmable device;

deriving the root and type of the chord from said harmony signal; then storing said root and type;

selecting a listing according to said chord type; and locating in said listing at least one accompaniment note according to said chord root and melody note, said locating step comprising:

generating an address of said listing according to the melody note and chord root; and reading the content of the listing at said address into a first register; and then generating an accompaniment note signal responsive to said at least one accompaniment note located.

15. A method as defined in claim 14 wherein the step of generating an accompaniment note signal comprises:

producing a stream of digital data bits by applying a clocking pulse to a second register; and entering a true indication into said second register only after the count of said first register is decremented to zero.

16. Apparatus for sounding at least one accompaniment note with respect to a preselected combination of melody and harmony notes comprising:

means for recognizing said melody notes and generating a signal responsive to the melody;

means for recognizing a chord from said harmony notes and generating a signal in response to said chord;

means for storing at least one accompaniment note which is a function of the harmonic relationship of the melody to the recognized chord and is not a tone of said chord;

means responsive to said signals for locating said at least one accompaniment note;

means for generating a signal representative of said at least one accompaniment note; and means responsive to said last-named means for sounding said at least one accompaniment note.

17. Apparatus as defined in claim 16 wherein said means for storing comprises at least one memory location of a programmable device.

18. Apparatus as defined in claim 17 wherein said means for locating comprises means for addressing said at least one memory location.

* * * * *